United States Patent [19]

Allen, Jr. et al.

[11] 4,317,121

[45] Feb. 23, 1982

[54] CONFORMAL HF LOOP ANTENNA

[75] Inventors: William P. Allen, Jr.; Benjamin S. Zieg, both of Atlanta, Ga.

[73] Assignee: Lockheed Corporation, Burbank, Calif.

[21] Appl. No.: 121,749

[22] Filed: Feb. 15, 1980

[51] Int. Cl.[3] ..... H01Q 11/32

[52] U.S. Cl. ..... 343/712; 343/744; 343/845

[58] Field of Search ..... 343/708, 712, 845, 846

[56] References Cited

U.S. PATENT DOCUMENTS

| | | | |
|---|---|---|---|
| 2,404,093 | 7/1946 | Roberts | 343/708 |
| 2,934,761 | 4/1960 | Kandoian | 343/708 |
| 2,996,713 | 8/1961 | Boyer | 343/712 |
| 3,172,110 | 3/1965 | Zieg | 343/708 |

FOREIGN PATENT DOCUMENTS

| | | | |
|---|---|---|---|
| 708799 | 5/1954 | United Kingdom | 343/712 |

*Primary Examiner*—Eli Lieberman

*Attorney, Agent, or Firm*—John J. Sullivan

[57] ABSTRACT

A flush-mounted HF (2 to 30 megahertz) transmitting and receiving antenna is developed which is especially suitable for installation on a Jeep (CJ7) type vehicle. This antenna is formed by bonding a copper strip to the inside surface of the non-metallic top of the vehicle. The strip is grounded to the vehicle body just aft of the driver's door and runs overhead to the aft right lower corner of the non-metallic vehicle top which becomes the feed point for the antenna. The strip is connected in two places to an isolated aluminum skin bonded to the top of the vehicle. The antenna is suitable for use as a transmitting antenna provided an impedance matching device (coupler) is inserted between the antenna and the transmitter/receiver.

5 Claims, 2 Drawing Figures

CONFORMAL HF LOOP ANTENNA

DESCRIPTION

1. Technical Field

This invention relates to radio antennas generally and more particularly to a high frequency (from 2 to 30 megahertz), two-way radio loop antenna which conforms to a supporting structure, to thereby afford special utility with respect to exposure i.e. visability as well as protection against damage. The antenna herein proposed is particularly useful for transmitting as well as receiving on vehicles, such as automibiles, trucks, boats and the like.

2. Background Art

Most vehicle antennas are for one-way operation only, i.e. receiving, in the high frequency band range. Where two-way operation is involved, i.e. both transmitting and receiving, the so-called whip antenna has been employed. This whip with a loading coil and/or coupler is located on the exterior of the vehicle. The principal disadvantages of these whips are their ready appearance and the likelihood of being torn off by objects, such as trees and low overhanging structures. This is especially true of military vehicles which must operate regardless of terrain.

Where conformal type of antennas have been used, these are either for receiving only or are not of the loop type which use the vehicle body for transmission and reception. Illustrative of such known conformal antennas are:

U.S. Pat. Nos. 2,094,168; 3,864,686;

British Patent No. 1,333,383.

U.S. Pat. No. 2,520,988 uses the vehicle body but proposes to excite the vehicle body from inside, being shielded by the body enclosure.

U.S. Pat. No. 2,980,110 is perhaps the closest known arrangement but is basically different from that proposed herein. This patented antenna or aerial comprises a shunt-fed vertical stabilizer on an aircraft which radiates because of currents traveling on the skin of the fuselage by virtue of the fact that the airframe, itself, is physically large enough to support resonances from wing tip to tail or from nose to tail, etc. There are in reality many other protuberances that support radiation of the various frequencies from 2 to 30 megahertz, and radiation is derived from many different resonant length modes.

DISCLOSURE OF INVENTION

In accordance with the present invention a conformal HF loop antenna is provided which consists of an inverted generally U-shaped metal preferably one of low loss or low resistance material, e.g. copper, connected to ground at one end and to an impedance matching device or coupler at the other end which in turn is grounded. The overall length of the antenna is such as to make it compatible with the characteristics of the coupler. For structural integrity the antenna may be mounted in non-conductive material and, if desired for enhanced performance, a connection point may be provided from the antenna to a ground plane.

This antenna operates as a small loop at the low end of its design frequency band and as a combination radiating loop and coupling device of RF energy through the ground return connections through the vehicle at the high end of the design frequency band. Because of the low resistive component of the loop impedance, the coupler is employed between the transmitter/receiver and the loop to transform the impedance into a value acceptable to the transmitter/receiver.

Where employed, the ground plane is excited as a part of the loop, and the individual antenna cables connected to the antennas on the ground plane are arranged as a part of the ground return system on the loop. The return currents across the grounded antenna ends also cause radiation, keeping the loop pattern from having the sharp, deep predictable nulls normal to the plane of the loop in cases where the grounded antenna ends are asymmetrical.

BRIEF DESCRIPTION OF DRAWINGS

The details of the present invention will be described in connection with the accompanying drawings, wherein.

DETAILED DESCRIPTION OF PREFERRED EMBODIMENT

Figure 1:
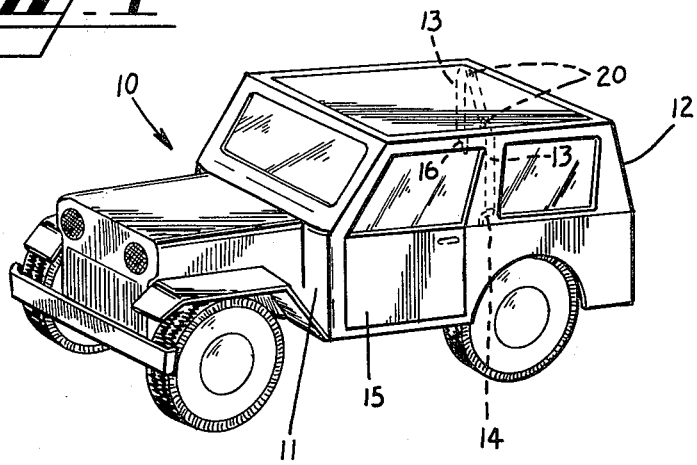
FIG. 1 is a perspective view of a vehicle in which an antenna designed and constructed in accordance with the teachings hereof is installed to show generally an application of the invention; and, FIG. 2 is a schematic of the antenna assembly illustrted in FIG. 1 to show the preferred form thereof.
Figure 2:
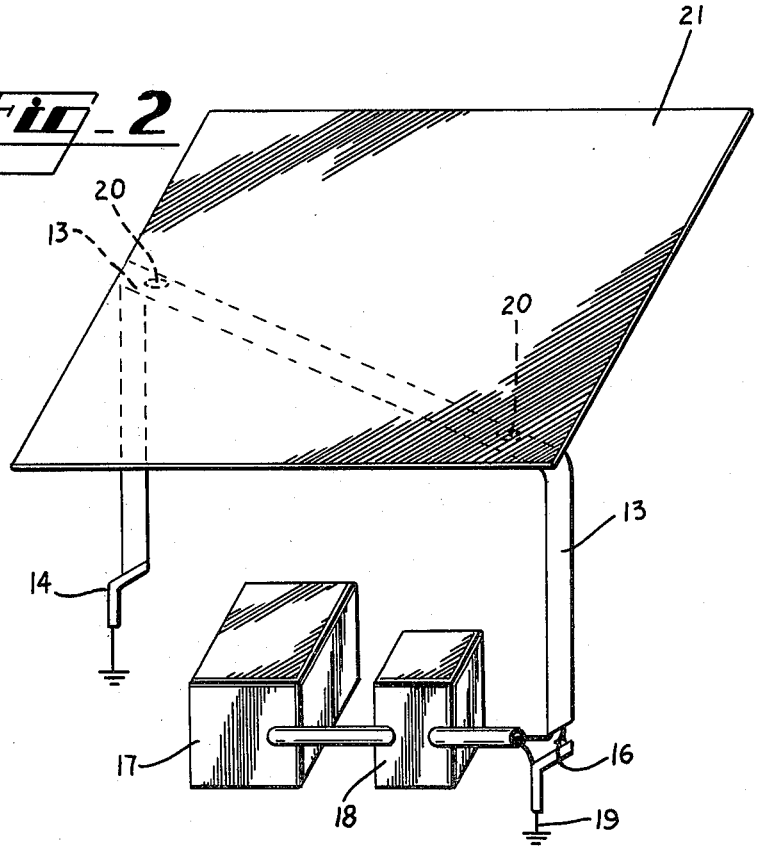

Referring more particularly to the drawings, 10 designates a ground vehicle, such as a CJ7 Jeep which is an all purpose automobile used by the military. This vehicle 10 has a metal frame and main body 11 and fiber glass top 12. An antenna is formed by bonding or otherwise securing a metal strip 13 of low loss/low resistance material, preferably copper, to the inside surface of the top 12. The strip 13 is grounded 14 by connection at one end to the body 11 just aft of the door 15 on the driver's side. The strip 13 extends overhead to the aft right lower corner of the vehicle top 12 and terminates in a feed point 16 adapted to be connected in conventional manner to a high frequency Receiver/Transmitter unit 17 through a coupler 18. The unit 17 and coupler 18 are in turn connected to ground 19, i.e. the vehicle body 11.

The strip 13 is connected in two places 20 to a conducting plate, e.g. an aluminum sheet 21 bonded or otherwise secured to the top 12. This arrangement serves to permit the operative connection of other antennas to a ground plane and thereby accommodate other communication systems on the vehicle 10.

The dimensions of the strip 13 are made to match the impedance of the particular coupler 18. The length may vary from about 40 inches to 100 inches and the width may vary from about 1/10 of an inch up to as much as 6 inches. In this case a 490T-1 automatic coupler manufactured and sold by Rockwell International, Collins Division, Dallas, Tex. was employed, and the impedance of the antenna was made compatible with the tuning capabilities of that coupler over a 2–30 megahertz frequency range. In this installation the strip 13 was copper approximately 2 inches wide and 67½ inches long. A length of RG-13/A (74 ohm) coaxial cable was used to transform the antenna impedance to make it compatible with the tuning capability of the Collins 490T-1 Coupler.

This antenna is designed and arranged to cause rf currents to flow on the skin of the vehicle body 11 which in turn cause radiation from the vehicle 10 in essentially all directions. By exciting currents on the conducting portion of the vehicle top 12 and body 11 in general a near omni-directional radiation pattern is obtained.

The antenna performance varies across the design band of operation. At the low end (frequencies between 2 and 10 MHz) the radiation pattern is essentially that of a small loop with a circumference of one-tenth of a wavelength or less. The radiation pattern shape is primarily vertically polarized and resembles a figure-eight. The asymmetrical mounting on the vehicle causes some radiation to occur in horizontal polarization in the direction of the vertically polarized nulls. At frequencies between 10 and 30 MHz the radiation pattern closely approximates that of a whip antenna. It has a near-omnidirectional pattern for vertical polarization with the elevation maximum near the horizon. There is essentially no cross polarization in the high range.

The impedance of the antenna generally exhibits very low values of resistance (R) and varying reactance (X) with frequency as illustrated below.

Basic Antenna Impedance

| Frequency MH2 | Impedance-Ohms |
|---|---|
| 2 | .5 + j24 |
| 3 | .73 + j36 |
| 4 | .97 + j49 |
| 5 | 1.34 + j63 |
| 6 | 1.90 + j77 |
| 7 | 2.25 + j93 |
| 8 | 3.00 + j108 |
| 9 | 3.51 + j128 |
| 10 | 4.54 + j150 |
| 11 | 6.36 + j180 |
| 12 | 8.15 + j212 |
| 13 | 12.87 + j263 |
| 14 | 21.3 + j320 |
| 15 | 41 + j468 |
| 16 | 208 + j834 |
| 17 | 2120 + j569 |
| 18 | 370 − j570 |
| 19 | 131 − j281 |
| 20 | 80 − j139 |
| 22 | 61 − j26 |
| 24 | 34 + j33 |
| 26 | 26 + j90 |
| 28 | 24 + j148 |
| 30 | 30 + j214 |

The impedance of the antenna is transformed by the series coaxial transformer to values of R and X that can be tuned by the selected coupler as illustrated below.

Antenna Impedance With Series Transformer

| Frequency MH2 | Impedance-Ohms |
|---|---|
| 2 | .9 + j34 |
| 3 | 1.14 + j54 |
| 4 | 1.68 + j77 |
| 5 | 2.58 + j108 |
| 6 | 4.59 + j155 |
| 7 | 7.79 + j230 |
| 8 | 17.4 + j400 |
| 9 | 158 + j1290 |
| 10 | 75 − j1080 |
| 11 | 13.4 − j385 |
| 12 | 8.0 − j225 |
| 13 | 5.5 − j158 |
| 14 | 3.8 − j110 |
| 15 | 3.0 − j86 |
| 16 | 3.2 − j62 |
| 17 | 4.7 − j45 |
| 18 | 5.6 − j29 |
| 19 | 7.5 − j13 |
| 20 | 10.5 + j0 |
| 22 | 58 + j58 |
| 24 | 215 + j0 |
| 26 | 25 − j67 |
| 28 | 10 − j24 |
| 30 | 71 − j1.0 |

Other couplers may require other pre-matching techniques. Slight changes in vehicle or antenna dimensions can significantly change these impedances.

We claim:

1. A conformal HF two-way radio loop antenna comprising an inverted generally U-shaped, continuous, single, radiating metal strip connected at one end to ground and at its other end to a grounded impedance matching device, said metal strip being one of low loss/-low resistance material with dimensions such as to make it compatible with the characteristics of said impedance matching device and secured to a non-conductive, relatively rigid material on top of a metal frame vehicle body, said strip being secured to said rigid material through a conducting plate.

2. The antenna of claim 1 wherein said metal strip is copper and has dimensions of approximately 67½ inches in length and approximately 2 inches in width.

3. The antenna of claim 1 wherein said vehicle is automotive and said metal strip is connected at one end to said vehicle body just aft of the door on the driver's side and extends overhead therefrom to the aft right lower corner of said vehicle top terminating in an end adapted to be connected to a HF receiver/transmitter through said impedance matching device.

4. The antenna of claim 1 wherein said metal strip has a length of between about 40 and 100 inches and a width of between 1/10 of an inch and 6 inches.

5. The antenna of claim 2 including a length of 74 ohm coaxial cable between said other metal strip end and said impedance matching device.

* * * * *